US008200110B2

(12) United States Patent
Chae

(10) Patent No.: US 8,200,110 B2
(45) Date of Patent: Jun. 12, 2012

(54) PRINTING APPARATUS WHICH REDUCES INITIAL PRINTING TIME AND PRINTING CONTROL METHOD

(75) Inventor: Su-kyoung Chae, Swoul (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 503 days.

(21) Appl. No.: 12/173,309

(22) Filed: Jul. 15, 2008

(65) Prior Publication Data

US 2009/0041494 A1 Feb. 12, 2009

(30) Foreign Application Priority Data

Aug. 6, 2007 (KR) ..... 10-2007-0078741

(51) Int. Cl.
*G03G 15/16* (2006.01)

(52) U.S. Cl. ..... 399/66; 399/297

(58) Field of Classification Search ..... None
See application file for complete search history.

(56) References Cited

U.S. PATENT DOCUMENTS 6,453,131 B1 * 9/2002 Sasai ..... 399/70
2005/0141920 A1 * 6/2005 Sato et al. ..... 399/167
2006/0283341 A1 * 12/2006 Otsuka ..... 101/35

* cited by examiner

*Primary Examiner* — David Porta
*Assistant Examiner* — Carolyn Igyarto
(74) *Attorney, Agent, or Firm* — Stanzione & Kim, LLP

(57) ABSTRACT

A printing apparatus includes a detection unit which detects a rotation period of a transfer belt, and a printing control unit which performs a printing preparation operation, and detects the rotation period if the printing preparation operation is started, and performs printing in the detected rotation period if the printing preparation operation is completed. Accordingly, a rotation period of the transfer belt is detected while performing the printing preparation operation, so that an initial printing time can be reduced.

13 Claims, 5 Drawing Sheets

PRINTING APPARATUS WHICH REDUCES INITIAL PRINTING TIME AND PRINTING CONTROL METHOD

CROSS-REFERENCE TO RELATED APPLICATIONS

This application claims priority under 35 U.S.C. §119 (a) from Korean Patent Application No. 10-2007-0078741, filed on Aug. 6, 2007, in the Korean Intellectual Property Office, the disclosure of which is incorporated herein by reference in its entirety.

BACKGROUND OF THE INVENTION

1. Field of the Invention

The present general inventive concept relates to a printing apparatus which reduces an initial printing time, and a printing control method thereof. More particularly, the present general inventive concept relates to a printing apparatus which reduces an initial printing time by detecting a rotation period of a transfer belt while performing a printing preparation operation, and a printing control method thereof.

2. Description of the Related Art

A printing apparatus is an apparatus which is connected to an external device, and prints images received from the external device onto paper. If the printing apparatus receives a printing signal from the external device, the printing apparatus starts a printing preparation operation, including supplying a high voltage, increasing a fixing temperature, and determining a transfer voltage. If the printing preparation operation is completed, the printing apparatus rotates a transfer belt, and senses a printing start point. The printing start point can be sensed using an identification mark formed on the transfer belt.

If the printing start point is sensed, the printing apparatus performs printing by operating developing units for each color at the printing start point. In this case, as the printing start point must be sensed, the initial printing time, that is, the first print-out time (FPOT), is delayed. In particular, if the identification mark on the transfer belt passes right before the printing preparation operation is completed, the initial printing time is delayed and extended. The delayed initial printing time results in a delayed print-out time, causing a user inconvenience. Accordingly, a user requires avoiding the delay of the printing time.

Therefore, it is necessary to provide methods for reducing the initial printing time.

SUMMARY OF THE INVENTION

The present general inventive concept provides a printing apparatus which reduces an initial printing time by detecting a rotation period of a transfer belt while performing a printing preparation operation, and by performing printing when the printing preparation operation is completed, and a printing control method thereof.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a printing apparatus including a detection unit which detects a rotation period of a transfer belt, and an engine control unit which performs a printing preparation operation, detects the rotation period if the printing preparation operation is started, and performs printing in the detected rotation period if the printing preparation operation is completed.

The detection unit may include a sensing unit which senses an identification mark on the transfer belt, and a calculation unit which calculates the rotation period of the transfer belt by measuring the time from the time when the identification mark is sensed until a time when the identification mark is sensed again.

The printing apparatus may further include a plurality of developing units corresponding to the number of different colors, wherein the engine control unit operates at least one of the plurality of developing units in the rotation period if the printing preparation operation is completed.

The engine control unit may designate as a printing reference location a location where printing is started after the printing preparation operation is completed, and the printing reference location is a location of the identification mark on the transfer belt.

The printing reference location may be disposed between a location where the printing preparation operation is completed and the location of the identification of the transfer belt.

The printing apparatus may further include a display unit, wherein the engine control unit operates the display unit to display the printing reference location.

The engine control unit may operate the display unit to display the printing reference location of the at least one of the developing units for each color.

The printing apparatus may further include a receiving unit which receives a location setting signal from a user, wherein the engine control unit starts printing at a location corresponding to the location setting signal after the printing preparation operation is completed, and performs printing in the detected rotation period.

The engine control unit may operate the detection unit to selectively detect the rotation period of the transfer belt.

The foregoing and/or other aspects and utilities of the present general inventive concept may also be achieved by providing a printing control method including detecting a rotation period of a transfer belt if a printing preparation operation is started, and performing printing in the detected rotation period if the printing preparation operation is completed.

The detecting of the rotation period of the transfer belt may include sensing an identification mark on the transfer belt, and calculating the rotation period of the transfer belt by measuring the time from the time when the identification mark is sensed until a time when the identification mark is sensed again.

In printing, at least one of the plurality of developing units may operate in the rotation period if the printing preparation operation is completed.

In printing, a location where printing is started may be designated as a printing reference location after the printing preparation operation is completed.

The printing reference location may be disposed a location of the identification mark on the transfer belt.

The printing reference location may be between a location where the printing preparation operation is completed and the location of the identification of the transfer belt.

The printing may include displaying the printing reference location. In displaying the printing reference location, the printing reference location of the at least one of the developing units for each color is displayed.

The printing control method may further include receiving a location setting signal from a user, wherein the printing include performing the printing at a location corresponding to the location setting signal after the printing preparation operation is completed, and is performed in the detected rotation period.

The rotation period of the transfer belt may be selectively detected.

The foregoing and/or other aspects and utilities of the present general inventive concept may also be achieved by providing a printing apparatus including a printing unit having a transfer medium to transfer the developed image, a detection unit to detect a rotation period of the transfer medium, and an engine control unit to perform a printing preparation operation, to control the detection unit to detect the rotation period if the printing preparation operation is started, and performs printing in the detected rotation period if the printing preparation operation is completed The foregoing and/or other aspects and utilities of the present general inventive concept may also be achieved by providing a printing apparatus including a printing unit having a photoconductive medium to form a developed image, and a transfer medium to receive the developed image from the photoconductive medium, and an engine control unit to control the printing unit to perform a printing to form the developed image and to transfer the developed image according to a rotation period of the transfer medium with respect to the photoconductive medium.

The engine control unit may control the printing unit to perform the printing a predetermined time after a printing preparation operation is completed.

The predetermined time may be zero.

The engine control unit may control the printing unit to transfer the developed image to a portion of the transfer medium regardless of a predetermined portion of the transfer medium with respect to the photoconductive medium.

The engine control unit may control the photoconductive medium and the transfer medium to perform a second printing according to the rotation period of the transfer medium.

The printing apparatus may further include a memory unit to store a preset rotation period as the rotation period of the transfer medium, wherein the engine control unit may perform the printing according to the rotation period and completion of an printing preparation operation.

The printing apparatus may further include a detection unit to detect the rotation period during a printing preparation operation or the printing.

The foregoing and/or other aspects and utilities of the present general inventive concept may also be achieved by providing a printing apparatus including a printing unit having a photoconductive medium to form a developed image, and a transfer medium to receive the developed image from the photoconductive medium; and an engine control unit to control the printing unit to perform a printing to form the developed image and to transfer the developed image according to a rotation period of the transfer medium regardless of a location of a predetermined portion of the transfer medium with respect to the photoconductive medium.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
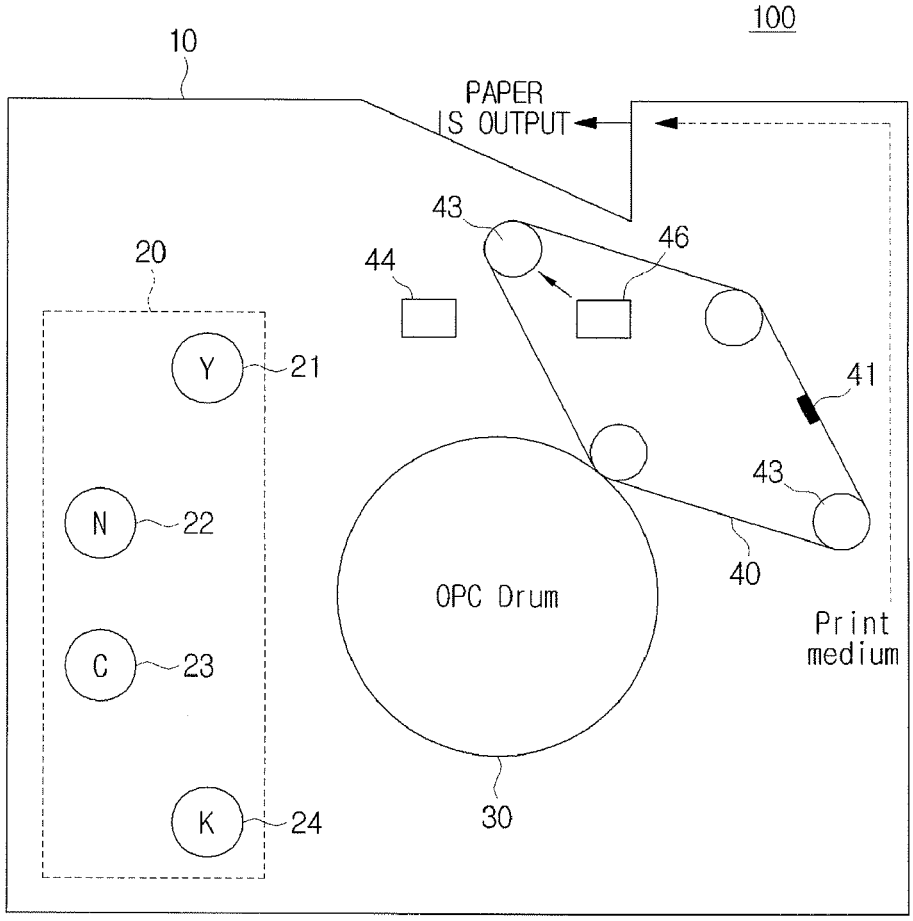
FIG. 1 is a mimetic diagram illustrating a printing apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a mimetic diagram illustrating an image forming apparatus, such as a printing apparatus 100, to form an image on a print medium according to an embodiment of the present general inventive concept. In FIG. 1, the printing apparatus 100 includes a main body 10 to accommodate units to perform printing preparation operation and printing operation, for example, a developing unit 20, a photoconductive drum 30, and a transfer medium such as a transfer belt 40. The units of the printing apparatus 100 may include a cassette unit, a high voltage supply unit, a fixing unit, and a laser scanning unit in addition to the above elements, but illustration and description thereof are omitted since these elements are well known.

The developing unit 20 includes a plurality of developing units, for example, first, second, third, and fourth developing units 21, 22, 23, and 24, to correspond to a plurality of color images using a plurality of color, which may be, for example, cyan, magenta, yellow, and black.

If laser beams are irradiated on a surface of the photoconductive drum 30, an electro-latent image is generated on the photoconductive drum 30. If a developer is jetted from the developing unit 20, the developer of the developing unit 20 is attached to the surface of the photoconductive drum 30 to develop the electro-latent image as a developed image.

The transfer belt 40 is a path for transferring a sheet of paper, and is in contact with the photoconductive drum 30.

If a sheet of paper is transferred onto the transfer belt 40, the developer attached to the photoconductive drum 30 is transferred onto the paper using the transfer belt 40. As an example, the developed image is transferred from the photoconductive drum 30 to the transfer belt 40 and then transferred to the sheet of paper from the transfer belt 40. In this case, a transfer unit is disposed to make contact with the transfer belt 40 through the sheet of paper, and the sheet of paper is transferred to a portion of the transfer belt 40 other than a contact between the photoconductive drum 30 and the transfer belt. Printing is performed in the above-described manner. Here, the developing unit 20, the photoconductive drum 30, and the transfer unit 40 may be referred to as a printing unit to form a developed image and to transfer the developed image from the photoconductive drum 30 to the transfer belt 40.

If the printing apparatus 100 receives a printing signal from an external device, a printing preparation operation is performed. The printing apparatus 100 operates each element to perform the printing preparation operation so that the printing apparatus 10 is in a printable state in which an image is developed, and the developed image is transferred to a transfer medium and/or a print medium. A rotation period of the transfer belt 40 is detected by rotating the transfer belt 40 during the printing preparation operation, and the first, second, third, and fourth developing units 21, 22, 23, and 24 are operated in order according to the rotation period. The rotation period can be detected by sensing an identification mark 41 formed on the transfer belt 40 using a sensor 44. An engine control unit of the printing apparatus 100 controls a driver 46 to rotate one or more rollers 43, so that the transfer belt 40 rotates.

The sensor 44 may be disposed adjacent to the transfer belt 40. It is possible that the sensor 44 may be disposed adjacent to a contact area (or nip) between the transfer belt 40 and the photoconductive drum 30. However, the present general inventive concept is not limited thereto. The sensor may be disposed to sense the identification mark 41 such that a printing initial time of the printing operation is reduced, and a delay of the printing operation is prevented.

Here, the initial printing time may be referred to a first printing time taken to form a first developed image using a first color developer and to transfer the first developed image on a print medium. That is, the initial printing time may correspond to a location of the transfer belt 40 where the first color developed image is transferred from the photoconductive drum 30 to the transfer belt 40. A second developed image using a second color developer is formed and transferred to a print medium in a second printing time following the first printing time. It is possible the first printing time may overlap a portion of the second printing time. Also, the second printing time may correspond to a location of the transfer belt 40 where the second color developed image is transferred from the photoconductive drum 30 to the transferred belt 40.

According to the present general inventive concept, the first printing time of a first printing operation can be reduced with respect to completion of the printing preparation operation since the first printing operation can start according to the rotation period of the transfer belt 40, that is, the transferring of the developed image to a print medium can start according to the rotation period of the transfer belt 40 rather than a determination of a predetermined portion of the transfer belt 40 is disposed with respect to a reference corresponding to the photoconductive drum 30, for example.

That is, a first printing of the printing operation can start upon completion of the printing preparation operation. In other word, it is not necessary to wait until predetermined portion of the transfer belt 40 is disposed with respect to a reference corresponding to the photoconductive drum 30. The printing can be performed regardless of a relative location of the identification mark 43 with respect to the sensing unit 43, the photoconductive drum 30 and/or the developing unit 20. Accordingly, the printing can be performed such that the developed image can be transferred to the transfer belt 40 at a random portion thereof.

Figure 7A:
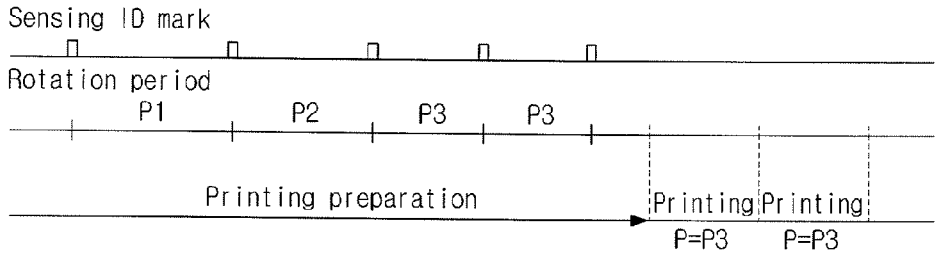
FIGS. 7A, 7B, 7C, and 7D are diagrams illustrating a relationship between a rotation period and a printing operation in an image forming apparatus.

As illustrated in FIG. 7A, the printing apparatus 10 controls the sensing unit 43 to detect the identification mark 43 and calculates rotation periods P1, P2, and P3 according to detections of the identification mark 43, and determines the rotation period P3 as the rotation period P of the transfer belt 40. And then the printing apparatus 10 performs the printing operation according to the determined rotation period P. When the printing operation can be repeated according to the determined rotation period P3 (P).

Figure 7B:
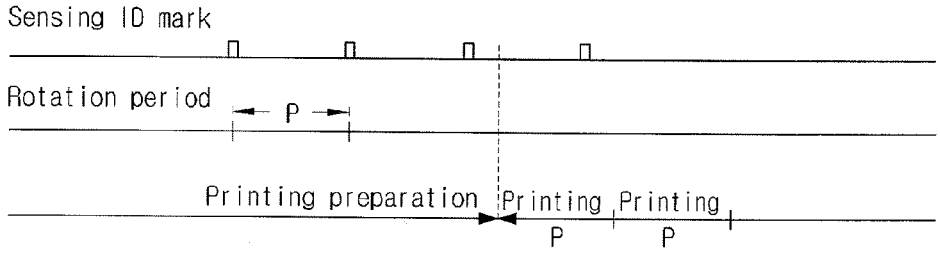
Figure 7C:
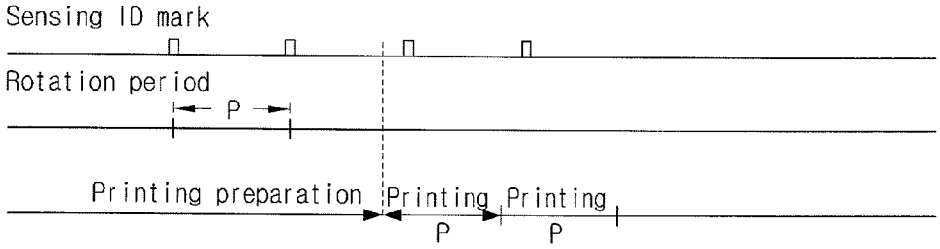

The rotation period P is calculated according to signals representing a location of the identification mark 43 during the printing preparation operation, and the printing starts when the printing preparation operation is completed. The printing is completed in the transfer belt 40 within the rotation period P, and the printing time of the printing can be reduced with respect to the completion of the printing preparation operation. The printing can be performed just after the identification mark 43 is in a sensing position as illustrated in FIG. 7B, or just before the identification mark 43 is in a sensing position as illustrated in FIG. 7C. Accordingly, the printing can be performed immediately after the printing preparation operation is completed without waiting the detection of the identification mark after the printing preparation operation is completed.

Figure 7D:
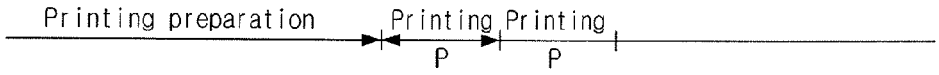

According to the present general inventive concept, a predetermined rotation period of the transfer belt 40 can be stored as the rotation period P in a memory unit of the printing apparatus 100, and an engine control unit of the printing apparatus 100 performs the printing according the stored predetermined rotation period immediately after the printing preparation operation is completed. As illustrated in FIG. 7D, the printing is performed according to the rotation period according to the completion of the printing preparation operation without the detection of the rotation period by the sensor.

The printing apparatus 100 performs printing in a multipass method. If the rotation period is detected, the first to fourth developing units 21 to 24 are operated in order according to the rotation period. The first to fourth developing units 21 to 24 are not always operated in the printing, and the first to fourth developing units 21 to 24 can be selectively driven in the printing according to the colors contained in a printing image.

The printing apparatus 100 may not sense the identification mark 41 of the transfer belt 40 using the sensor 43 after the printing preparation operation, but the printing apparatus 100 may control related elements to start the printing using the rotation period detected during the printing preparation operation, so that the initial printing time can be reduced.

Figure 2:
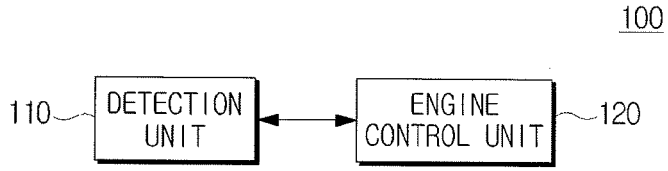
FIG. 2 is a block diagram illustrating a printing apparatus according to an embodiment of the present general inventive concept.

FIG. 2 is a block diagram illustrating the printing apparatus 100 of FIG. 1 according to an embodiment of the present general inventive concept. With reference to FIGS. 1 and 2, the printing apparatus 100 includes a detection unit 110, and an engine control unit 120.

The detection unit 110 detects the rotation period of the transfer belt 40, which is a period of time taken to make one rotation of the transfer belt with respect to a reference location. The reference location may be a portion of the transfer belt 40.

The engine control unit 120 receives a printing signal, and performs the printing preparation operation. During the printing preparation operation, the engine control unit 120 operates the detection unit 110 to detect the rotation period of the transfer belt. That is, if a printing signal is received, the engine control unit 120 concurrently performs the printing preparation operation, and detects the rotation period of the transfer belt 40. Subsequently, if the printing preparation operation is completed, the engine control unit 120 carries out the printing in the detected rotation period. Accordingly, the time period taken to wait for the identification mark, i.e., time period taken to detect the identification mark, is unnecessary, so the initial printing time can be reduced.

Figure 3:
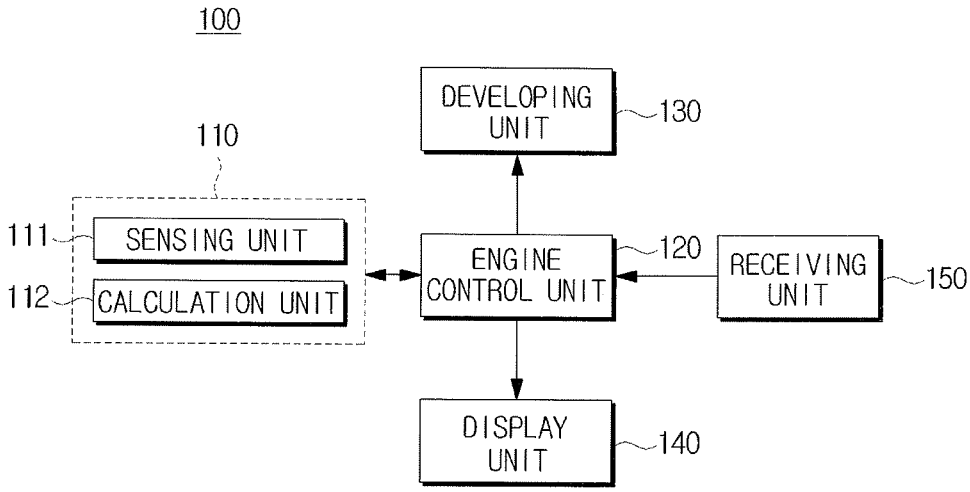
FIG. 3 is a block diagram illustrating the printing apparatus of FIG. 2.

FIG. 3 is a block diagram illustrating in more detail the printing apparatus of FIG. 2. In FIG. 3, the printing apparatus 100 includes a detection unit 110, an engine control unit 120, a developing unit 130, a display unit 140, and a receiving unit 150.

The detection unit 110 includes a sensing unit 111 and a calculation unit 112.

The sensing unit 111 senses a portion of a transfer belt. The portion of the transfer belt may be a portion randomly sensed by the sensing unit 111, or a predetermined portion, that is, an identification mark representing the predetermined portion of the transfer belt. More specifically, the sensing unit 111 may be an optical sensor which senses the identification mark by emitting and receiving light. The identification mark may be formed in a groove or may protrude from the transfer belt.

The calculation unit 112 calculates the rotation period of the transfer belt. More specifically, the calculation unit 112 measures a period of time from a time when the sensing unit 111 senses the identification mark for the first time until the sensing unit 111 senses the identification mark again. As a result, the calculation unit 112 can calculate the time period taken for the transfer belt to make one rotation, that is, the rotation period.

The detection unit 110 selectively detects the rotation period of the transfer belt while printing is performed. For example, if the manufacturer or the designer of the printing apparatus 100 designs the detection unit 110 to detect the rotation period of the transfer belt during printing, the rotation period of the transfer belt can be detected during printing.

The developing unit 130 includes developing units for each color, such as cyan, magenta, yellow, and black, which are generally used in color printing apparatuses.

The display unit 140 displays graphic images.

The receiving unit 150 receives user signals which are input by the user using keys or touch pads mounted on the main body 10 of the printing apparatus 100 of FIG. 1.

The engine control unit 120 receives a printing signal, and performs the printing preparation operation. During the printing preparation operation, the engine control unit 120 operates the detection unit 110 to detect the rotation period of the transfer belt. The printing preparation operation, including supplying a high voltage to one or more printing-related units, increasing a fixing temperature of a fixing unit, preparing for laser scanning on photoconductive drum, and determining a transfer voltage of a transfer unit, is the operation performed to prepare for printing. The engine control unit 120 performs the printing preparation operation by controlling respective units to supply the high voltage, to increase the fixing temperature, to prepare the laser scanning, and to determine the transfer voltage.

The engine control unit 120 carries out printing if the printing preparation operation and/or the rotation period detection are completed. A location where printing starts on the transfer belt is designated as a printing reference location, and may be a location where the identification mark is formed on the transfer belt. It is possible that the location is spaced apart from the identification mark.

It is also possible that when one or more printing preparation operations and/or one or more printing operations to correspond to the respective printing preparation operations are performed, locations may be different from each other since the locations on the transfer belt where the printing starts are determined according to starting positions of the printing operation to corresponding to ending times of the respective printing preparation operations. In this case, when developed images are transferred from the photoconductive drum to the transfer belt and/or the print medium in the respective printing operations, the transferred images are disposed at positions according to the respective locations on the transfer belt.

The engine control unit 120 operates the display unit 140 to display the printing reference location. The printing reference location, which is the location where printing starts, may be displayed in a graphic image. Accordingly, the user can identify the graphic image on the display unit 140, and realize the printing start location. The display unit 140 may display the printing reference location for the developing unit for each color. For example, when color data are printed, the printing start location on the transfer belt for the developing unit for each color can be displayed, and when mono data are printed, the printing start location on the transfer belt for the developing unit for black can be displayed. In this case, the printing reference location may be between the location where the printing preparation operation is completed and the location where the identification mark on the transfer belt is detected.

Alternatively, if a printing location setting signal is received through the receiving unit 150, the engine control unit 120 starts printing at the set printing location after the printing preparation operation is completed, and performs printing in the rotation period detected by the detection unit 110. In this case, the engine control unit 120 can compare the printing location set according to the printing location setting signal with the location of the identification mark, and start printing at the closer location to the completion of the printing preparation operation.

Subsequently, if the printing preparation operation is completed, the engine control unit 120 sequentially operates the developing units for each color according to the detected rotation period. In more detail, if the printing preparation operation is completed, the engine control unit 120 sequentially operates the developing units for a first color, a second color, a third color, and a fourth color every rotation period, so that images for the respective colors overlap to form a color image.

The engine control unit 120 performs the printing preparation operation and the rotation period detection when image data having a single color (mono color) are printed as well as when image data having a plurality of colors are printed.

Figure 4:
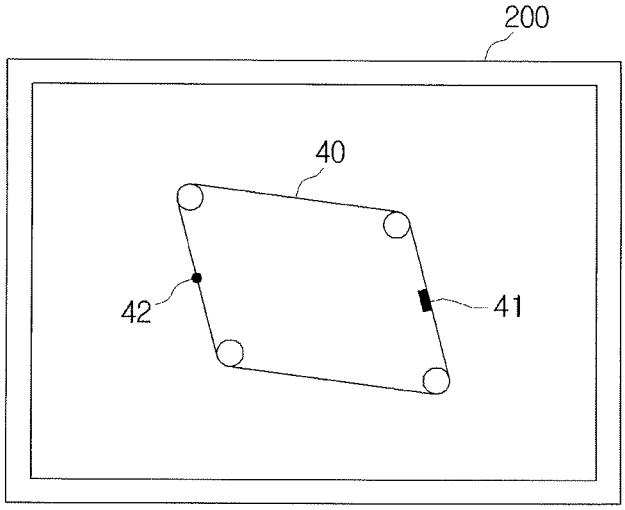
FIG. 4 is a mimetic diagram illustrating an image to display a transfer belt and a printing reference time according to an embodiment of the present general inventive concept.

FIG. 4 is a mimetic diagram illustrating a displayed image of a transfer belt and a printing reference time in the printing apparatus 100 according to an embodiment of the present general inventive concept. In FIG. 4, a display panel 200 displays a transfer belt 40, an identification mark 41, and a printing reference location 42 as a graphic image. The printing reference location 42 may be a printing location set by the user, or a location where printing is started after the printing preparation operation is completed. The printing reference location 42 displayed on the display panel 200 may be the same location as the identification mark 41.

The printing reference location 42 may be displayed differently for each color. For example, when four colors are printed, or when a single color (that is, mono color is printed, the printing reference location 42 may be different.

Figure 5:
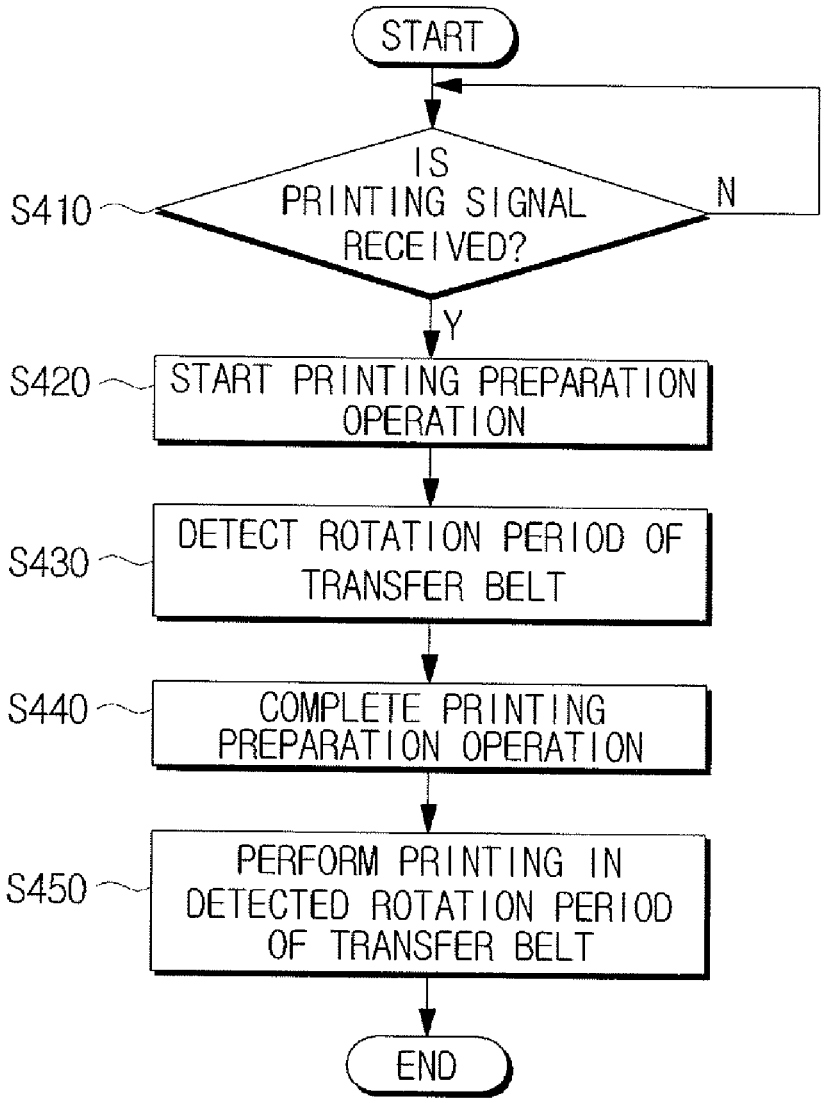
FIG. 5 is a flow chart illustrating a printing control method of a printing apparatus according to an embodiment of the present general inventive concept.

FIG. 5 is a flow chart illustrating a printing control method of a printing apparatus according to an embodiment of the present general inventive concept. With reference to FIGS. 1 through 5, the printing apparatus 100 receives a printing signal in operation S410, and starts the printing preparation operation in operation S420. The printing preparation operation is the operation to prepare for printing, including supplying a high voltage, increasing a fixing temperature, preparing for laser scanning, and determining a transfer voltage.

Subsequently, in operation S430, the printing apparatus 100 detects the rotation period of the transfer belt during the printing preparation. The rotation period is the time taken for the transfer belt to make one rotation.

If the printing preparation operation is completed in operation S440, the printing apparatus 100 performs printing in the detected rotation period of the transfer belt in operation S450. Therefore, as soon as the printing preparation operation is completed, printing is performed, so the initial printing time can be reduced.

Figure 6:
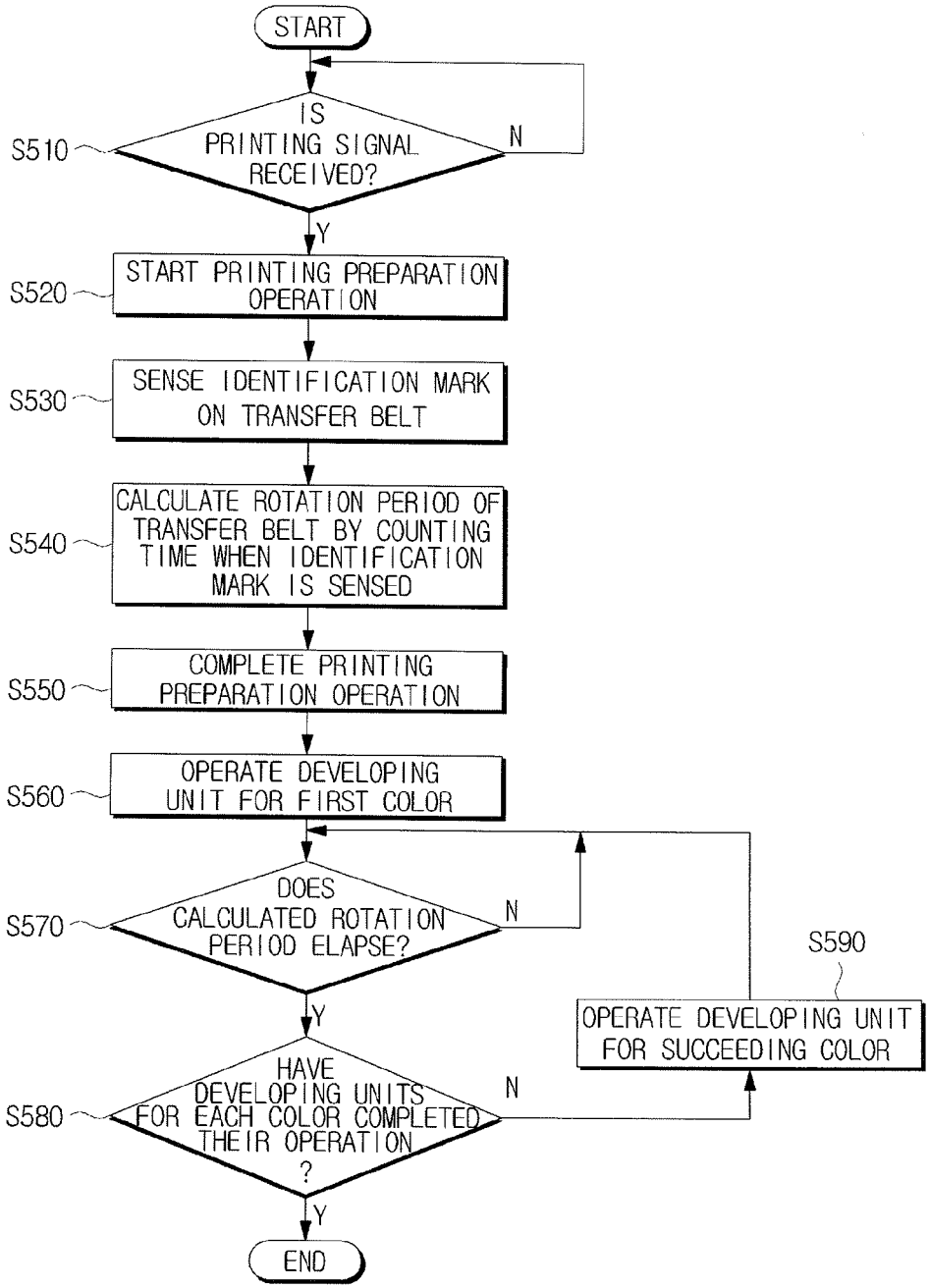
FIG. 6 is a flow chart illustrating the printing control method of FIG. 5.

FIG. 6 is a flow chart illustrating in more detail the printing control method of FIG. 5. With reference to FIGS. 5 and 6, the printing apparatus 100 receives a printing signal in operation S510, and starts the printing preparation operation in operation S520.

In operation S530, the printing apparatus 100 senses the identification mark on the transfer belt. In more detail, the identification mark which is formed in a groove or as a protrusion on the transfer belt, so the identification mark can be sensed using a sensor. The sensor may be an optical sensor which senses the identification mark by emitting and receiving light.

Subsequently, in operation S540, the printing apparatus 100 calculates the rotation period of the transfer belt by measuring the time from when the identification mark is sensed. More specifically, the printing apparatus 100 measures the time from the moment when the identification mark is sensed for the first time until the identification mark is sensed again. As a result, the printing apparatus 100 can calculate the rotation period of the transfer belt, that is, the time taken for the transfer belt to make one rotation. For example, if the transfer belt rotates and the time when the identification mark is sensed for the first time is considered to be 0, the rotation period is counted from the sensed time. If the identification mark is sensed again after 3 seconds, the rotation period of the transfer belt is calculated as 3 seconds.

If the printing preparation operation is completed in operation S550, the printing apparatus 100 operates the developing unit for the first color to perform printing in operation S560. In more detail, when color images are printed, developer such as toner is jetted onto the photoconductive drum by operating the developing unit for the first color. Subsequently, if paper passes between the transfer belt and the photoconductive drum, an image is generated on the paper.

Next, in operation S570, after the transfer belt is rotated to print the first color, the printing apparatus 100 identifies whether or not the rotation period calculated in operation S540 elapses. For example, the printing apparatus identifies whether or not three seconds elapse from the time when the transfer belt is rotated to print the first color.

If the rotation period elapses, the printing apparatus 100 identifies whether the developing units for each color have completed their operation in operation S580. If the developing units for each color have completed their operation, printing is completed.

In operation S590, if the developing units for each color have not completed their operation in operation S580, the developing unit for subsequent color is operated to perform printing in operation S590. All colors are printed by repeating operations S570 and S580. For example, if image data includes diverse colors, the four developing units for cyan, magenta, yellow, and black are operated. In this case, the developing units may be sequentially operated in the rotation period of the transfer belt, so the printing start location for each color is the same.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A printing apparatus comprising:

a detection unit to detect a rotation period of a transfer belt by detecting a rotation of the transfer belt; and an engine control unit to perform a printing preparation operation to place the printing apparatus in a printable state, to control the detection unit to detect the rotation period when the printing preparation operation is started, and performs printing based on the detected rotation period when the printing preparation operation is completed, wherein the engine control unit designates as a printing reference location, a location on the transfer belt where the printing is started after the printing preparation operation is completed, and further comprising:

an identification mark formed on the transfer belt, wherein the printing reference location is a location of the identification mark on the transfer belt.

2. The printing apparatus of claim 1, wherein the detection unit comprises a sensing unit to sense the identification mark on the transfer belt; and a calculation unit to calculate the rotation period of the transfer belt by measuring a time from a time when the identification mark of the transfer belt is sensed until a time when the identification mark is sensed again.

3. The printing apparatus of claim 1, further comprising:

a plurality of developing units corresponding to a number of different colors, wherein the engine control unit operates at least one of the plurality of developing units based on the rotation period when the printing preparation operation is completed.

4. The printing apparatus of claim 3, further comprising:

a display unit, wherein the engine control unit operates the display unit to display the printing reference location.

5. The printing apparatus of claim 4, further comprising:

wherein the engine control unit operates the display unit to display the printing reference location of the at least one of the developing units for each color.

6. The printing apparatus of claim 1, wherein the printing unit includes a photoconductive medium to form a developed image.

7. The printing apparatus of claim 6, wherein the engine control unit controls the photoconductive medium and the transfer belt to perform a second printing according to the rotation period of the transfer belt.

8. A printing control method comprising:

detecting a rotation period of a transfer belt by detecting a rotation of the transfer belt in response to starting a printing preparation operation that places a printing apparatus in a printable state;

performing printing based on the detected rotation period when the printing preparation operation is completed, wherein during the printing, a location where printing is started is designated as a printing reference location after the printing preparation operation is completed, and wherein the printing reference location is a location of an identification mark on the transfer belt.

9. The printing control method of claim 8, wherein the detecting of the rotation period of the transfer belt comprises:

sensing the identification mark formed on the transfer belt; and calculating the rotation period of the transfer belt by measuring a time from when the identification mark is sensed until a time when the identification mark is sensed again.

10. The printing control method of claim 9, wherein in the printing, at least one developing unit among a plurality of developing units operates in the rotation period when the printing preparation operation is completed; and the at least one developing unit corresponds to a color.

11. The printing control method of claim 10, wherein printing comprises displaying the printing reference location.

12. The printing control method of claim 11, wherein the displaying of the printing reference location comprises displaying the printing reference location of the at least one developing unit among the plurality of the developing units.

13. A printing apparatus comprising:

a printing unit having a transfer medium to transfer a developed image;

a detection unit to detect a rotation period of the transfer medium by detecting a rotation of the transfer medium;

an engine control unit to perform a printing preparation operation to place the printing apparatus in a printable state, to control the detection unit to detect the rotation period when the printing preparation operation is started, and performs printing based on the detected rotation period when the printing preparation operation is completed, wherein the engine control unit designates as a printing reference location, a location on the transfer belt where the printing is started after the printing preparation operation is completed, and further comprising:

an identification mark formed on the transfer belt, and wherein the printing reference location is a location of the identification mark on the transfer belt.

* * * * *